US008182652B2

(12) United States Patent
Englert et al.

(10) Patent No.: US 8,182,652 B2
(45) Date of Patent: May 22, 2012

(54) METHOD OF MAKING A COATING AND A COATED ACOUSTICAL PANEL USING DEGRADED FIBERS

(75) Inventors: Mark Englert, Libertyville, IL (US); Runhai Lu, Wauconda, IL (US); Matthew Langdon, Cloquet, MN (US)

(73) Assignee: United States Gypsum Company, Chicago, IL (US)

( * ) Notice: Subject to any disclaimer, the term of this patent is extended or adjusted under 35 U.S.C. 154(b) by 144 days.

(21) Appl. No.: 12/729,801

(22) Filed: Mar. 23, 2010

(65) Prior Publication Data

US 2011/0232854 A1 Sep. 29, 2011

(51) Int. Cl.
*D21F 11/00* (2006.01)

(52) U.S. Cl. ..... 162/129

(58) Field of Classification Search ..... 162/129, 162/123, 141, 143, 145, 157.1; 442/44, 43
See application file for complete search history.

(56) References Cited

U.S. PATENT DOCUMENTS

| | | | |
|---|---|---|---|
| 1,769,519 | A | 7/1930 | King et al. |
| 2,046,296 | A | 6/1936 | Boos et al. |
| 2,993,802 | A | 7/1961 | Cascone |
| 3,283,849 | A | 11/1966 | Schirick et al. |
| 3,480,104 | A | 11/1969 | Austin et al. |
| 3,779,860 | A | 12/1973 | Oshida et al. |
| 4,153,503 | A | 5/1979 | Booth et al. |
| 5,071,511 | A | 12/1991 | Pittman |
| 5,817,262 | A | 10/1998 | Englert |
| 6,443,256 | B1 | 9/2002 | Baig |
| 6,616,804 | B2 | 9/2003 | Foster et al. |
| 7,033,963 | B2 | 4/2006 | Felegi, Jr. et al. |
| 7,393,424 | B2 | 7/2008 | Schwartz et al. |
| 2002/0096278 | A1 | 7/2002 | Foster et al. |
| 2004/0062898 | A1 | 4/2004 | Felegi, Jr. et al. |
| 2006/0128863 | A1 | 6/2006 | Felegi, Jr. et al. |

FOREIGN PATENT DOCUMENTS

| | | |
|---|---|---|
| GB | 2 335 431 | 9/1999 |

*Primary Examiner* — Mark Halpern
(74) *Attorney, Agent, or Firm* — Greer, Burns & Crain, Ltd.; Pradip Sahu, Esq.; Philip T. Petti, Esq.

(57) ABSTRACT

An acoustical panel is made by applying a thin, acoustically-transparent coating to an acoustical base mat. A pulp is made from one or more fillers, a fibrous filler, a binder and water. A thickener solution is prepared from a thickener and water. A portion of the pulp and the thickener solution are mixed under high shear conditions to degrade the fibrous filler and form a smooth coating. The coating is applied to and distributed over a base mat and the coated base mat is then cut and dried to form a coated acoustical panel. The panel is free of visible mineral nodules on the surface of the coating. Optionally, the pulp is a portion of a pulp used to make the base mat. Other embodiments include the use of recycled dust or fine particles of the acoustical panel obtained from cutting or shaping the base mat or coated panels.

19 Claims, 2 Drawing Sheets

METHOD OF MAKING A COATING AND A COATED ACOUSTICAL PANEL USING DEGRADED FIBERS

FIELD OF THE INVENTION

This invention relates to a coating for a fiber-containing acoustical panel. More specifically, it relates to a coated acoustical panel having good sound reducing properties and a smooth, aesthetically pleasing surface.

BACKGROUND OF THE INVENTION

Acoustical panels are well-known for use in ceilings, walls, room dividers, and anywhere sound absorbency is a potential problem. Acoustical tiles, also known as acoustical panels, ceiling tiles or ceiling panels, are well known in the building trades for providing a ceiling that is quickly installed, inexpensive and lightweight. The tiles are prepared from a slurry of fibers, fillers and binders, most frequently by either a casting process or a felting process.

In the water felting of such a slurry, a dispersion of a fiber, a filler, a binder and other ingredients flow onto a moving, porous support, such as that of a Fourdrinier or Oliver mat forming machine for dewatering. The dispersion dewaters first by gravity and then vacuum suction means. The wet basemat is dried in heated convection drying ovens forming a dried panel. Optionally, sound absorbance is increased by creating cavities in the product surface by, for example, needling, pinholing or embossing. The dried panels are then cut to the desired dimensions and optionally top coated, such as with paint, to produce finished acoustical tiles and panels.

Acoustical tile is also made by a wet pulp molded or cast process such as that described in U.S. Pat. No. 1,769,519. A molding composition that includes fibers, fillers, colorants and a binder is prepared for molding or casting the body of the tile. This mixture is placed upon suitable trays which have been covered with paper or a paper-backed metallic foil and then the composition is screeded to a desired thickness with a screed bar or roller. A decorative surface, such as elongated fissures, may be provided by the screed bar or roller. The trays filled with the pulp are then placed in an oven to dry or cure the composition. The dried sheets are removed from the trays and may be treated on one or both faces to provide smooth surfaces, to obtain the desired thickness and to prevent warping. The sheets are then cut into tiles of a desired size.

Current trends favor acoustic panels having a smooth, monolithic surface, similar to the adjoining drywall. During the production of cast panels, wool nodules in the panel tend to lend texture to the surface, thereby creating pores or pockets that are sound-absorbent. Many layers or coatings are known to provide a smooth surface, but these layers or coatings do not necessarily allow sound to pass through the coating and enter the acoustically absorbent panel. Any acoustically transparent coating for a panel should provide a smooth, monolithic, aesthetically pleasing finish. This finish is greatly preferred by users of such panels. The coating should maintain the current product features of being hard and durable, have a low volatile content and maintain a Class A classification.

Granulated or nodulated wool is mineral wool that is formed into pea-shaped pellets. Unlike conventional mineral wool fibers, it is convenient for measuring, pouring and transferring the material through hoppers or pipes. The nodulated wool is often used in the manufacture of base acoustical panels. U.S. Pat. No. 6,616,804, for example, teaches the use of nodulated wool in an acoustic base panel. More specifically, it discloses creating a nodulated overlay layer starting with baled wool and mixing at 40 rpm to form wool nodules in situ. The overlay is then joined with a wet fiberboard panel and the two layers are dried together to make an acoustical panel.

U.S. Pat. No. 6,443,256 to Baig, herein incorporated by reference, also teaches the use of nodulated wool overlay layer as a means of improving sound absorption. However, there are no teachings to suggest the use of degraded mineral wool in a coating as a means of providing a smooth coating. Preparation of some overlay layers can result in the need for special equipment to prepare and distribute the coating. Use of the overlay layer of the '804 patent requires at least perforating equipment and an oscillating screed blade. Purchase, installation and maintenance on this additional equipment increase the cost of the acoustical panel.

Another problem associated with the manufacture of acoustical panels with an acoustically transparent overlay layer is the cost incurred in purchasing, receiving, storing and dispensing a large number of ingredients for the base panel and the coating. As taught above, based mineral wool is useful in the panel, but nodulated wool fibers are used in the coating. These and other differences in the content of the overlay layer compared to the panel thus add to the cost of producing the finished acoustical panel.

It would be advantageous to find an acoustically transparent smooth coating for an acoustical panel. It would further be advantageous if the coating were thinly applied to the base mat using known coating equipment to minimize coating costs. Still further, it would be beneficial if the coating utilized many of the same components as the base panel to minimize the cost of obtaining and utilizing extra ingredients.

BRIEF DESCRIPTION OF THE INVENTION

Figure 1:
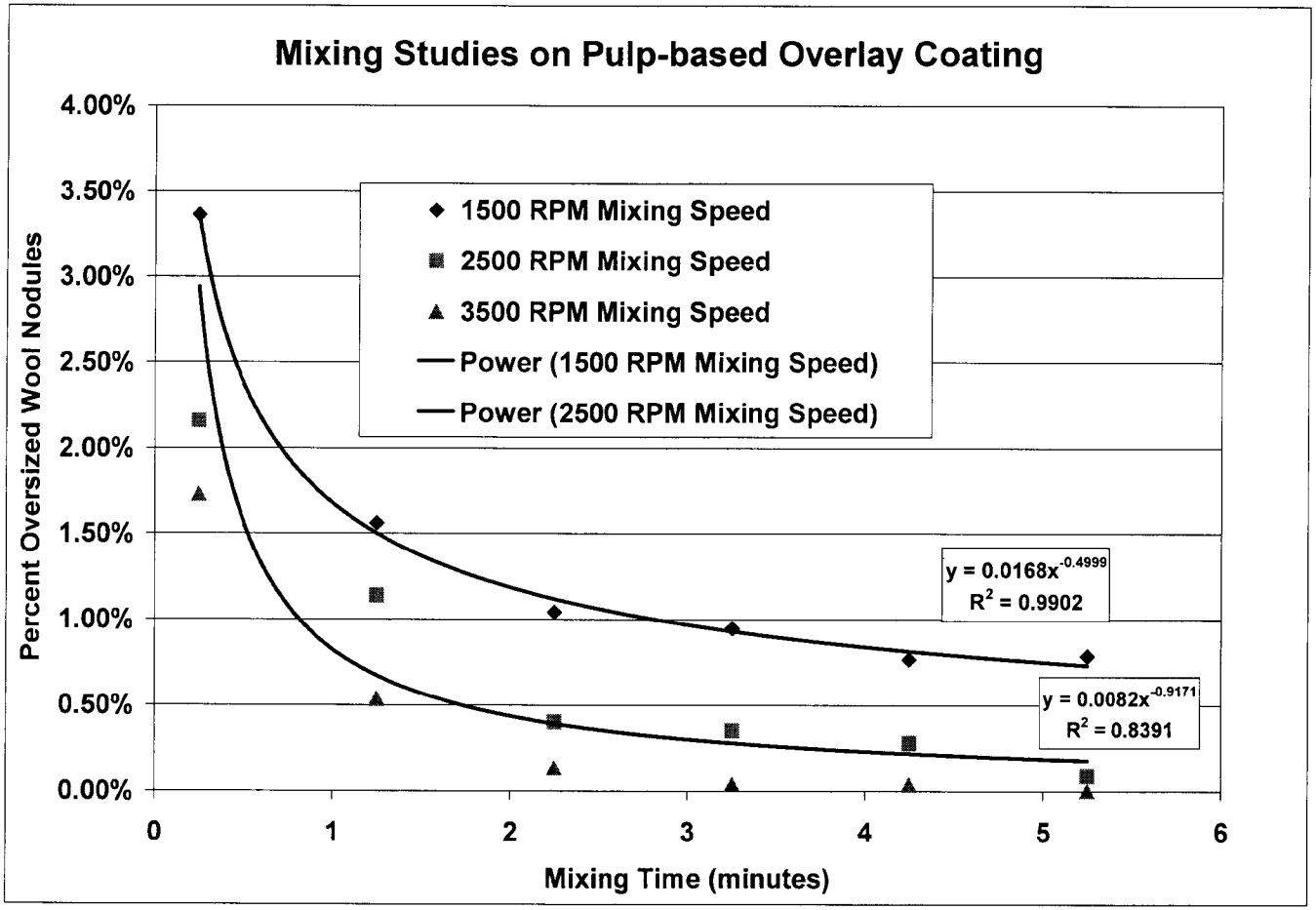
FIG. 1 is a graph of the data of Example 1 showing the amount of nodulated wool remaining after mixing at various speeds for various lengths of time.

At least one of these advantages will be recognized by one of ordinary skill in the art in the present method of making an acoustical panel. More specifically, the present method features application of a very thin, acoustically-transparent coating to an acoustical panel made by first preparing a thickener solution consisting of a thickener and water. At least a portion of the thickener solution, one or more fillers, a fibrous filler, a binder and water are sent to a mixer where it is mixed under high shear conditions to degrade the fibrous filler and form a smooth coating. The coating is applied to a base mat. The coating is distributed over the base mat and the coated base mat is then cut and dried to form a coated acoustical panel. Following application and distribution of the coating, the coating is free of visible nodules on the surface of the coating.

In some embodiments of the invention, one or more fibers, a filler, binder and water are combined to form a pulp. A first portion of the pulp is deposited onto a moving support to form the base mat. A second portion of the pulp and a portion of the thickener solution are sent to a high-shear mixer where the mixer contents are mixed under conditions of high shear to degrade the mineral wool fibers and form a coating. The coating is applied to and distributed over the base mat and allowed to dry.

The coating of this panel is advantageously made using many of the same ingredients as are used in the base mat. In some embodiments, the coating is made from a portion of the pulp used to form the base mat. This method limits the number of steps needed for adding and measuring the extra ingredients. Preparing the coating in this manner reduces the cost of the coated panel significantly. Other embodiments include the use of recycled dust or fine particles of the acoustical panel obtained when cutting or shaping the base mats. In at least one embodiment of the invention, the coating is made primarily from materials recycled from the base mats.

Properties of the panel prepared by this method include not only a smooth, monolithic surface, but one that is acoustically transparent. The present coating allows sound to be transmitted through the coating into the fibrous base panel where it dissipates. Self-leveling of the surface contributes to the smoothness of the panel. The surface is also durable due to the presence of reinforcing fibers.

DETAILED DESCRIPTION OF THE INVENTION

Two common methods are utilized for making acoustical panels. One is a wet felting process similar to that used to make paper. A fiber-containing slurry is deposited on a foraminous wire to form a base mat. The second type of process is a casting method wherein the pulp is cast onto a moving surface. In either method for preparing the base mat, it is shaped into a panel. Cast products are generally denser than felted panels. The instant process is herein described in terms of a casting process, however, one skilled in the art would readily understand how to adapt it for use in a felting process or any other known method of making an acoustical panel. Unless otherwise stated, concentrations of compositions discussed herein are expressed by weight based on the dry solids weight.

A coating for an acoustical base mat or base panel is prepared by adding one or more fillers and fibers to a thickener solution also containing at least one binder and water. Water is present in the coating formula in amounts of about 70% to about 90%, based on the total weight of the wet mass. Water used in the coating formula should be as pure as practical to reduce the amounts of salts and other impurities that may be present. Formation of a suitable coating is also dependent on the temperature of the water. Warm water is used in many embodiments of the coating, where the water temperature is from about 80° F. (27° C.) to about 150° F. (66° C.).

The coating includes one or more binders. In some embodiments, the binders include starches, polymeric binders, stucco and mixtures thereof. Examples of starches include, but are not limited to granular starches such as pearl starch, corn starch, wheat starch, potato starch and combinations thereof. Derivatized starches may also be used. Starch is very cost efficient and is used as the binder in many embodiments of this invention. In at least one embodiment, the binder is prepared by dispersing starch particles in water and heating the starch slurry until the starch is fully cooked and the starch slurry thickens into a viscous gel. The cooking temperature of the starch slurry should be closely monitored to assure full swelling of the starch granules. A representative cooking temperature for cornstarch is about 180° F. (82° C.) to about 195° F. (90° C.). Starch is optionally used as a binder without pre-cooking, as it can form a gel during the process of drying the base panel.

Polymeric binders are also useful, such as a thermoplastic binder (latex). These latex binders may have a glass transition temperature ranging from about 30° C. to about 110° C. Examples of latex binders include polyvinyl acetate, polystyrene, vinyl acetate/acrylic emulsion, vinylidene chloride, polyvinyl chloride, styrene/acrylic copolymer, styrene/butadiene and carboxylated styrene/butadiene.

The thickener is present in amounts of about 1.5% to about 3% by weight of the coating. At least one embodiment of the overlay coating utilizes NATROSOL B (Aqualon, Wilmington, Del.) as the thickener. During the manufacture of the overlay coating, if it is necessary to adjust the viscosity of the coating, the amount of thickener, water or total solids are adjusted to produce a coating of an appropriate viscosity. In the preparation of the thickener solution, the water and thickener are added together and stirred until the thickener is fully dissolved. The length of time needed for stirring is dependent upon the type of mixer, the temperature of the water and the exact type of thickener used. Using a high shear mixer, a 2% solution of Natrosol B in warm water was stirred for 10 minutes to form a suitable solution.

A fibrous filler is added to the coating to improve sound transparency and to provide hardness and durability. Mineral wool is used in many embodiments as the fibrous filler due to its fire-resistance and because it does not serve as a food source for vermin, molds or bacteria. The term "mineral wool" refers to a fibrous wool produced from mineral materials, such as slag or basalt. The use of granular or nodulated wool is convenient because it is pourable and free-running. Nodulated wool is also formed from mineral wool fibers in the pulp mixer. This material is in the form of small, porous balls of irregular shape. They are generally the size of a pea or larger, often having a diameter in the range of about 3 to about 6 mm. Mineral wool made by any known process, is suitable for this composition. Amounts of the fibrous filler used in this process are at least 65%, but can also vary from about 65% to about 90% wt % by weight based on the dry solids in the pulp. Some embodiments utilize from about 70% to about 80% fibrous filler by weight on the same basis. The fiber length varies, but is preferably about 1 mm to about 4 mm.

Additional fillers are also used in the coating formula to give it the proper consistency. Examples of suitable fillers include stucco and acoustical panel dust. Stucco is also known as calcium sulfate hemihydrate, Plaster of Paris or calcined gypsum. It reacts with the water, hydrating the calcium sulfate hemihydrate to form an interlocking matrix of calcium sulfate dihydrate crystals. The stucco is available in several crystal forms. The most common are alpha-calcined and beta-calcined forms. Alpha-stucco is calcined under pressure to produce a long, needle-like crystal. The crystal of the beta-calcined stucco is made by calcining gypsum at atmospheric pressure, thereby generating a less acicular crystal form. Either the alpha or beta form, or combinations thereof, is useful as one of the fillers in the instant coating.

In some embodiments, dust captured by a dust gathering system is recycled for use as a filler in the panel, the coating or both. Acoustical panel dust is the dust generated in grinding or cutting operations during manufacture of the acoustical panel when a saw is used to separate the panels made by a felting or casting process or when tools are used to detail the edges of the panel. In the production of the panel, the total amount of filler is maintained approximately constant. The dust and the stucco are optionally substituted for each other and for other fillers. In at least one embodiment of the coating, the dust is at least 50% of the weight of the coating solids, but can range from about 50% to 85% by weight of the dry components of the coating. Some embodiments of the coating include from about 70% to about 90% by weight dust.

Water is used in the coating to thin it and to make it self-leveling. After mixing and water addition, the fibers of the fibrous filler are broken down into shorter fibers that flow more readily. Water is preferably added to make a coating having a solids content of at least 10% or from about 10% to about 30% weight percent solids or from about 15% to about 30% by weight based on the total weight of the coating.

The coating is made by placing the fibrous filler, the non-fibrous filler, binder, water and the thickener solution into a high-shear mixer. One suitable mixer is a Ross high-shear mixer. It is a high-shear disperser-type mixer and is available as a batch mixer or an in-line mixer. Other useful mixers will be known to an artisan. High mixing speeds are used to create the high-shear conditions. Mixing is maintained until the nodulated fibrous filler has been degraded to a large degree by separation of the individual fibers. The mixing also degrades the mineral wool by breaking it down into shorter fibers even when no or few nodules are present, resulting in a smooth coating being formed. Smoothness of the coating is determined by washing a sample of the coating through a #10 sieve (U.S. Standard Sieve Series) until only the oversized nodules remain on the sieve. The coating was considered smooth when less than 0.5% by weight of the nodulated fibrous fibers remained on the sieve. Another measure of smoothness is if there are no nodules or lumps visible to the naked eye in the coating mixture. The specific time and mixing speed required depend upon the type of mixer, the type and amount of nodulated fibrous filler. Example 1 demonstrates a number of mixing times and mixing speeds and the amount of oversized nodules remaining on the sieve.

Optionally, reinforcing fibers are sent to the high shear mixer with the other coating components. Up to 4% by weight of the solids in the coating are added reinforcing fibers. Examples of suitable reinforcing fibers include Short Stuff ESS50F from Minifibers, Inc. available through Hall Technologies, Inc. (St. Louis, Mo.). These fibers are hydrophilic polyethylene fibers having an average length of 0.1 mm and diameter of 5 μm. Similar fibers that are also useful include E795 Hydrophilic fibers and E385 Hydrophilic fibers also available from Hall Technologies, Inc. The use of other known reinforcing fibers in the coating is also contemplated. Up to about 3% by weight fiber based on the weight of the wet pulp or from about 0.5% to about 2% are used in some embodiments.

After making the coating, it is applied to the base panel having acoustical properties. The method of coating is unimportant, so that conventional coating methods such as curtain coating, roller coating and rod coating are suitable. In some embodiments, the coating is applied by flooding the surface of the wet-end of the panel with the self-leveling coating. When ready to apply, the coating has about the consistency of paint. It can flow over the surface of the base panel while the base panel is still wet on the production line. The coating is spread over the width of the base panel and excess coating is removed using, for example, one or more smoothing or screed bars. The smoothing bar has a glass plate affixed to a steel bar that is positioned over the surface of the panel. The glass plate contacts the wet surface of the slab at an acute angle. If excess coating is present in an area, it builds up behind the smoothing bar then flows due to gravity to a lower area of the panel. In some embodiments, the angle is from about 20° to about 40°.

The coating of this invention can be applied in a thickness as thin as $1/16^{th}$ of an inch (1.6 mm). Thickness of the coating can range from about $1/16^{th}$ of an inch (1.6 mm) to $1/8^{th}$ of an inch (3 mm) or even to ¼ of an inch (6 mm). If thinner coatings are desired, conditions in the high-shear mixer can be made more severe or the coating can be mixed longer to further reduce the size of the nodules.

Another feature of this invention is that many of the materials used to make the coating are already present during the manufacture of the base panels. At least two embodiments for assembly of the component materials is foreseen for preparation of the coating. In a first embodiment, all of the raw materials are taken from the bins, hoppers, pipes, bags or other storage vehicles, measured and combined as stated above. In some embodiments, the components are fed from the same containers as those used to supply the basic components to the base panel. In this embodiment, the dry components are optionally blended together prior to their addition to the high-shear mixer ("the mixer").

In a second embodiment, the coating is made using a number of the same components as the base panel and a portion of the base panel pulp is drawn from the base panel line to make the coating. The fibrous filler, binder and fillers are commonly used in the manufacture of the base panel, sometimes in the same proportion. In this embodiment, a portion of the pulp is sent to the high-shear mixer along with additional water and thickener to form the coating. Amounts of components are added to the pulp portion to adjust the proportions of the components, if necessary. After the component amounts have been corrected, the coating is combined in the high-shear mixer as described above.

Other minor ingredients as are known to one skilled in the art can be used in this coating. These ingredients include, but are not limited to, pigments such as $TiO_2$, defoamers, biocides and the like. One particularly useful additive is sodium trimetaphosphate, which reduces sag in acoustical panels.

Any panel having acoustical properties is useful in the instant method. Preparation and application of the coating as described fills in holes, cracks, fissures or other imperfections in the panel surface with the coating which allows sound to be transmitted through the coating and into the interior of the acoustical panel. There, sound energy is at least partially converted into mechanical or thermal energy and dissipated. One embodiment of the panel is described below, but it is understood that this description does not limit the choice of base panels in any way.

An example of a base panel suitable for use with this coating is a FROST® Brand Acoustical Ceiling Panel made by USG Corp., Chicago, Ill. It is a fine-textured panel made by a casting process. Cast panels have the advantage of having color distributed throughout the panel, making scratches or cuts in the panel less noticeable. Application of the subject coating fills in holes or indentations in the surface of the panel, giving it a smoother texture and a more monolithic appearance.

EXAMPLE 1

A 2% solution of thickener in water was prepared. 3200 Grams of water was weighed and placed in a beaker. Using a high-speed propeller mixer, 80 grams of Natrosol B thickener from Aqualon (Wilmington, Del.) was added to the water. The solution was stirred for ten minutes.

Pulp for a cast acoustical panel was prepared from 75.05% % mineral wool, 12.79% starch, 11.51% stucco, 0.64% boric acid and 0.01% sodium hexametaphosphate The wet overlay coating was prepared by weighing 1628.0 grams of the pulp, 500.0 grams of 2% Natrosol B solution prepared above and 1443.0 grams of water into a large metal beaker. A Ross High-Shear Mixer (Charles Ross & Son Company, Hauppauge, N.Y.) was used to blend the components using the setting and mixing time shown in Table I below. The mixer was fitted with a 3 inch (76 mm) diameter, saw-tooth, stainless steel blade.

Initially, the mixing time was set to 15 seconds. An approximate 140 gram sample was collected from the pulp mixture using a small ladle and transferred into a tared glass beaker. The pulp mixture was mixed for one additional minute, then an additional 140 gram sample was obtained. Mixing for one minute followed by taking of a sample was, continued until a total of 5.25 minutes of mixing time had elapsed. This yielded a total of 6 samples.

Samples were collected using a small ladle (about 140 grams) and placed into a tared beaker. The beaker and sample were weighed and the weight was recorded. About 1.5 inches (41 mm) of water was placed in a 5 gallon bucket. A #10 sieve from the U.S. Standard Sieve Series, having 2 mm or 0.078 inch openings, was placed in the water so that the water level reached halfway up the side of the sieve. A sample was added to the sieve in the bucket, and the sieve was repeatedly raised and lowered to "wash out" all components of the coating except large wool nodules. Loose fibers of mineral wool easily passed through the sieve. Balls of nodulated wool that did not pass through the sieve were collected and transferred back to an assigned, tared beaker. The wool nodule-containing solution was dried in a 250° F. (121° C.) oven to determine the amount of wool nodules obtained. Results of the wet sieving tests at various mixing times and mixing speeds are shown in Table I.

TABLE I

WET SIEVING TESTS

| + | OD beaker | Mix % Over-sized | Mixer | | beaker | |
|---|---|---|---|---|---|---|
| Sample # | Time (min) | Speed (rpm) | beaker wt. | sample wt. | +wool wt. | wool nodules |
| 1 | 0.25 | 1500 | 236.11 | 371.74 | 240.67 | 3.36% |
| 2 | 1.25 | 1500 | 230.03 | 367.18 | 232.17 | 1.56% |
| 3 | 2.25 | 1500 | 236.77 | 375.85 | 238.22 | 1.04% |
| 4 | 3.25 | 1500 | 217.77 | 355.12 | 219.07 | 0.95% |
| 5 | 4.25 | 1500 | 225.35 | 365.04 | 226.42 | 0.77% |
| 6 | 5.25 | 1500 | 218.08 | 360.49 | 219.20 | 0.79% |
| 7 | 0.25 | 2500 | 196.83 | 340.98 | 199.94 | 2.16% |
| 8 | 1.25 | 2500 | 222.16 | 360.93 | 223.74 | 1.14% |
| 9 | 2.25 | 2500 | 220.71 | 352.17 | 221.24 | 0.40% |
| 10 | 3.25 | 2500 | 215.80 | 346.48 | 216.26 | 0.35% |
| 11 | 4.25 | 2500 | 175.48 | 293.04 | 175.81 | 0.28% |
| 12 | 5.25 | 2500 | 217.44 | 343.35 | 217.55 | 0.09% |
| 13 | 0.25 | 3500 | 220.41 | 360.00 | 222.82 | 1.73% |
| 14 | 1.25 | 3500 | 224.80 | 344.02 | 225.44 | 0.54% |
| 15 | 2.25 | 3500 | 175.84 | 294.80 | 176.00 | 0.13% |
| 16 | 3.25 | 3500 | 218.38 | 325.77 | 218.42 | 0.04% |
| 17 | 4.25 | 3500 | 197.13 | 303.52 | 197.17 | 0.04% |
| 18 | 5.25 | 3500 | 194.38 | 297.31 | 194.38 | 0.00% |

FIG. 1 shows the results in graphic form. As the mixing time increased, or the mixing speed increased, the percentage of wool nodules that did not pass through the #10 Sieve decreased. This demonstrates the breakdown of the wool nodules in response to high shear mixing. Selection of the mixing conditions and/or mixing time can be determined in this manner depending on the acceptable size for the remaining nodulated fibrous filler.

EXAMPLE 2

A 2% solution of Natrosol B and water was prepared according to the method of Example 1. The pulp of Example 1 was made into acoustical panels. Dust generated during the manufacture and cutting of the panels was screened through a 16 mesh screen and used to prepare an overlay coating made up of 77.5% cast dust, 20.0% mineral wool and 2.5% thickener. The components were placed in a large metal beaker and mixed for the required time using the Ross High-Shear Mixer fitted with a 3 inch (76 mm) saw-tooth stainless steel blade. The coating mixture was mixed at the speed and mixing time indicated in Table 2 below.

Figure 2:
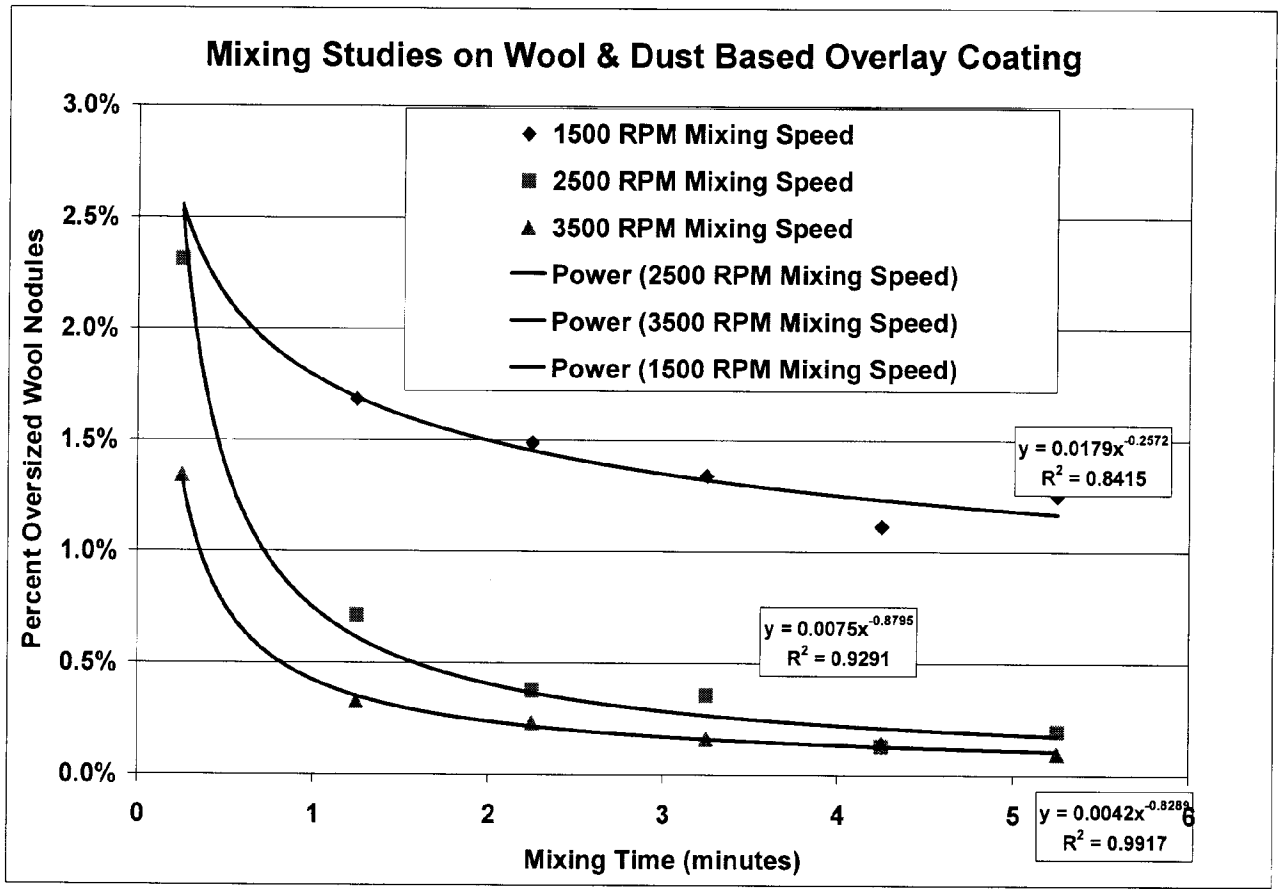
FIG. 2 is a graph of the data of Example 2 showing the amount of nodulated wool remaining after mixing at various speeds for various lengths of time.

At the conclusion of each mixing time, an approximate 100 gram sample is reserved. Mixing is restarted for an additional minute. The mixing and sampling continues until a total of 5.25 minutes of mixing time has elapsed. Each of the samples was sieved according to the test method described in Example 1. Results of the test are presented in Table II and graphically in FIG. 2.

TABLE II

WET SIEVE RESULTS FROM A DUST-BASED OVERLAY

| + | Mix OD beaker | Mix Over-sized | Mixer | | beaker | |
|---|---|---|---|---|---|---|
| Sample # | Time (min) | Speed (rpm) | beaker wt. | sample wt. | +wool wt. | wool nodules |
| 1 | 0.25 | 1500 | 231.14 | na | na | |
| 2 | 1.25 | 1500 | 198.83 | 324.85 | 200.95 | 1.7% |
| 3 | 2.25 | 1500 | 222.41 | 355.42 | 224.39 | 1.5% |
| 4 | 3.25 | 1500 | 198.59 | 324.08 | 200.27 | 1.3% |
| 5 | 4.25 | 1500 | 216.51 | 337.82 | 217.86 | 1.1% |
| 6 | 5.25 | 1500 | 224.71 | 353.47 | 226.32 | 1.3% |
| 7 | 0.25 | 2500 | 191.15 | 309.75 | 193.89 | 2.3% |
| 8 | 1.25 | 2500 | 234.51 | 353.64 | 235.36 | 0.7% |
| 9 | 2.25 | 2500 | 244.81 | 356.28 | 245.23 | 0.4% |
| 10 | 3.25 | 2500 | 227.63 | 337.33 | 228.02 | 0.4% |
| 11 | 4.25 | 2500 | 222.15 | 315.81 | 222.27 | 0.1% |
| 12 | 5.25 | 2500 | 187.62 | 285.53 | 187.81 | 0.2% |
| 13 | 0.25 | 3500 | 213.58 | 331.44 | 215.16 | 1.3% |
| 14 | 1.25 | 3500 | 221.11 | 315.82 | 221.42 | 0.3% |
| 15 | 2.25 | 3500 | 218.23 | 309.55 | 218.44 | 0.2% |
| 16 | 3.25 | 3500 | 221.55 | 302.81 | 221.68 | 0.2% |
| 17 | 4.25 | 3500 | 192.55 | 269.81 | 192.66 | 0.1% |
| 18 | 5.25 | 3500 | 191.58 | 265.43 | 191.65 | 0.1% |

As the mixing speed and mixing time increased, the amount of wool nodules decreased.

EXAMPLE 3

A thickened gel solution was made by combining water, starch, stucco, dust and boric acid in the proportions of Table III.

TABLE III

GEL FORMULATION

| Component | Weight | Percent of Total | Percent of Solids |
|---|---|---|---|
| Cold Water | 1250 | 20.72% | N/A |
| Hot Water | 4000 | 66.28% | N/A |
| Steam | 200 | 3.31% | N/A |
| Starch | 300 | 4.97% | 51.28% |
| Stucco | 195 | 3.23% | 33.33% |
| Dust | 75 | 1.24% | 12.82% |
| Boric Acid | 15 | 0.25% | 2.56% |
| Total Gel Formula | 6035 | 100% | 100% |

The above gel solution was combined with mineral wool and water to make the pulp formulation.

TABLE IV

| PULP COMPOSITION | | | |
|---|---|---|---|
| Component | Weight | Percent of Total | Percent of Solids |
| Gel Formula | 2100 | 78.95% | 26.65% |
| Mineral Wool | 600 | 21.05% | 73.35% |
| Total Pulp | 2700 | 100% | 100% |

The pulp composition was used to make panels and also used in the preparation of an overlay coating.

TABLE V

| | Weight | Percent, Total Coating Basis | Percent, Solids Basis |
|---|---|---|---|
| Pulp | 195.5 | 41.0% | 98.0% |
| Thickener | 1.15 | 0.2% | 2.0% |
| Water | 280.0 | 58.8% | 0.0% |
| Total Solids | 57.3 | 100.0% | 100.0% |
| Total Weight | 476.7 | | |

When the coating was complete, it was applied to the surface of a standard Frost Acoustical Ceiling Panel. It was then spread using a smoothing bar to achieve a uniform distribution.

EXAMPLE 4

A 2% NATROSOL® solution was prepared by weighing 3920 grams of warm water and adding 80 grams of Natrosol B from Hercules. The solution was stirred for 20 minutes using a propeller mixer.

Next, an overlay coating was prepared by screening dust gathered by a dust collection system through a 16 mesh screen (1.19 mm openings) to remove large particles. Ten grams of Short Stuff Fiber, 765 grams of board dust and 200 grams of mineral wool were measured into separate containers.

Water (2775 grams) and a 2% Natrosol solution (1250 grams) were weighed and combined in a large metal beaker. A Ross mixer was started at 2500 rpm. Mineral wool was added gradually to the aqueous solution. As it thickened, the mixer speed was increased to 3500 rpm. A timer was set for five minutes and started when the wool began to turn over. Near the end of the mixing time, the fibers and dust were added to the coating mix. When the coating was complete, it was applied to the surface of a standard Frost® Acoustical Ceiling Panel (USG Corp., Chicago, Ill.). It was then spread using a smoothing bar to achieve a uniform distribution.

While a particular embodiment of the overlay coating has been shown and described, it will be appreciated by those skilled in the art that changes and modifications may be made thereto without departing from the invention in its broader aspects and as set forth in the following claims.

What is claimed is:

1. A method of making an acoustically transparent coating for application to the surface of an acoustical panel comprising:

preparing a thickener solution comprising a thickener and water;

sending a portion of the thickener solution, one or more fillers, a fibrous filler, a binder and water to a mixer;

mixing the mixer contents under conditions of high shear selected to degrade the fibrous filler to form a smooth coating;

applying the coating to a base mat;

distributing the coating over the base mat surface, wherein the coating is free of visible nodules following application allowing the coated base mat to dry, and cutting the coated base mat into acoustical panels.

2. The method of claim 1 wherein the amount of water in said preparing and sending steps results in a coating having no more than 30 wt % solids.

3. The method of claim 1 wherein the coating of said distributing step averages less than ⅛ inch (3 mm) in thickness.

4. The method of claim 1 wherein said applying step comprises wet end flooding.

5. The method of claim 1 further comprising collecting panel dust while cutting and shaping base panels and acoustical panels, and wherein said one or more fillers of said sending step comprises recycled dust from said collecting step.

6. The method of claim 1 further comprising including reinforcing fibers in the high-shear mixer in said sending step.

7. The method of claim 1 wherein the one or more fillers comprises gypsum.

8. The method of claim 1 wherein the coating comprises at least 10% of the fibrous filler based on the weight of the dry solids.

9. The method of claim 5 wherein the coating comprises at least 50% of the panel dust based on the weight of the dry solids.

10. The method of claim 1 wherein the temperature of the water in said preparing step is from about 80° F. (27° C.) to about 150° F. (121° C.).

11. A method of making an acoustically transparent coating for application to the surface of an acoustical panel comprising:

preparing a gel comprising a filler, binder and water;

sending a portion of the gel, and a fibrous filler to a mixer to form a pulp;

utilizing a first portion of the pulp to form a base mat;

preparing a thickener solution comprising a thickener and water;

placing a second portion of the pulp in a high-shear mixer with a first portion of the thickener solution;

mixing the high-shear mixer contents under conditions of high shear selected to degrade the fibrous filler to form a smooth coating;

applying the coating to the base mat;

distributing the coating over the base mat, wherein the coating is free of visible nodules following application and distribution of the coating on the base mat surface;

allowing the coated base mat to dry; and cutting the coated base mat into acoustical panels.

12. The method of claim 11 wherein the amount of water in said preparing and sending steps results in a coating having no more than 30 wt % solids.

13. The method of claim 11 wherein the coating of said distributing step averages less than ⅛ inch (3 mm) in thickness.

14. The method of claim 11 wherein said applying step comprises wet end flooding.

15. The method of claim 11 further comprising collecting panel dust while shaping base panels and acoustical panels, and wherein said one or more fillers of said sending step comprises recycled dust from said collecting step.

16. The method of claim 11 further comprising including reinforcing fibers in the high-shear mixer in said sending step.

17. The method of claim 11 wherein the one or more fillers comprises gypsum.

18. The method of claim 11 wherein the coating comprises at least 69% fibrous filler.

19. The method of claim 11 wherein the temperature of the water in said preparing step is from about 80° F. (27° C.) to about 150° F. (121° C.).

* * * * *